United States Patent [19]

Watten

[11] Patent Number: 5,003,727

[45] Date of Patent: Apr. 2, 1991

[54] APPARATUS FOR IMPROVING DOOR SECURITY

[76] Inventor: Edwin E. Watten, 1908 S. 40th Ave., Yakima, Wash. 98903

[21] Appl. No.: 540,855

[22] Filed: Jun. 20, 1990

Related U.S. Application Data

[63] Continuation-in-part of Ser. No. 339,518, Apr. 17, 1989, abandoned.

[51] Int. Cl.[5] ..... E06B 1/04; E05C 21/02

[52] U.S. Cl. ..... 49/504; 49/460; 292/346

[58] Field of Search ..... 49/504, 460, 462; 52/514; 292/346, 340

[56] References Cited

U.S. PATENT DOCUMENTS

| | | | |
|---|---|---|---|
| 3,290,081 | 12/1966 | Sushan | 292/346 |
| 3,645,045 | 2/1972 | Gervis et al. | 292/346 X |
| 3,676,966 | 7/1972 | Ragland | 49/504 X |
| 3,918,207 | 11/1975 | Aliotta | 49/504 X |
| 4,057,275 | 11/1977 | La Beaud | 49/504 X |
| 4,174,862 | 11/1979 | Shane | 292/346 |
| 4,635,399 | 1/1987 | Gehrke et al. | 49/504 X |
| 4,684,160 | 8/1987 | Nelson | 292/340 |
| 4,770,452 | 9/1988 | Petree, Jr. | 49/504 X |
| 4,802,701 | 2/1989 | Mazie | 292/346 X |
| 4,854,621 | 8/1989 | Baldwin | 49/504 X |

*Primary Examiner*—Philip C. Kannan
*Attorney, Agent, or Firm*—Mark Zovko

[57] ABSTRACT

A strike plate support used in conjunction with a strike plate and a latch bolt or dead bolt. The strike plate for receiving the latch bolt or deadbolt is fastened to the strike plate support which has a portion that is fastened to the back surface of the door jamb. An improvement in door security strength is realized as the strike plate support will prevent breaking of the door jamb caused by sudden concentrated force exerted to the door by unwanted intruders. Optionally, the strike plate support in addition to being fixed to the door jamb can also be secured to the framing lumber for enhanced strength.

4 Claims, 2 Drawing Sheets

APPARATUS FOR IMPROVING DOOR SECURITY

CROSS RELATION TO OTHER U.S. APPLICATION

This application is a continuation-in-part of U.S. application Ser. No. 7/339,518 filed 4/17/89 now abandoned.

BACKGROUND OF THE INVENTION

1. Field of the Invention

This invention relates in general to an improvement in the locking system for conventional doors and more particularly to a strengthened locking system for a door having a latch bolt or dead bolt and a strike plate.

2. Discussion of the Prior Art

As can be readily seen from the inspection of a conventional door leading to the outside such as the front door of most residences, the strike plate is a weak link when door strength and security is considered. Even with relatively strong locks and relatively strong doors, the strike plate, i.e. the plate which receives the bolt from a door lock when the door is locked, is fastened only to the door jamb by a pair of screws. To breach the security of such a locking system can be relatively simple to burglars and other unwanted intruders, as a well placed, hard blow to the locked door will result in many cases in the strike plate ripping from the door jamb and/or the door jamb breaking. To improve door security, options such as adding additional locks or more sophisticated locks are available. These options, however, when compared to the present invention are more complex and necessarily more expensive, and due to these reasons are not in widespread use in new home construction. The apparatus of the present invention, therefore, provides a simple, relatively low cost way of strengthening the security a locked door can offer which can be used both in new construction and retrofitted to existing doors in a straightforward manner.

SUMMARY OF THE INVENTION

The apparatus of the present invention includes as its key element a strike plate support fastened to the exterior or back surface of a door jamb. The exterior back surface of the door jamb is the surface adjacent the door framing on a conventionally hung door. Typically, the door jamb would be mounted to conventional framing such as 2×4's. The strike plate support would have a spanning section which would fit between the framing and door jamb fastened to the back side of the door jamb and optionally fastened also to the framing and a strike for receiving a latch or dead bolt. A conventional strike plate can be fastened to the strike box portion of the strike plate support by suitable fasteners such as a pair of bolts with nuts. The strike plate would be adapted to receive either a latch bolt or a dead bolt which would be part of the locking mechanism of the door lock.

The resulting combination of the strike plate and the strike plate support fastened as described to the door jamb and optionally fastened to the framing itself would result in an overall improvement in the security of the door when locked.

It is an object of the present invention to provide improved security for conventional locking doors.

Another object of the present invention is to provide a strengthened door lock system which prevents movement of the strike plate when force is exerted upon the door.

A further object of the present invention is to provide a strike plate support for improving locking strength of doors for use with both a latch bolt lock and a dead bolt lock.

These and other objects and advantages of the present invention will become more apparent from the following detailed description when taken in conjunction with the drawings herein included.

DETAILED DESCRIPTION OF THE PREFERRED EMBODIMENT

Figure 1:
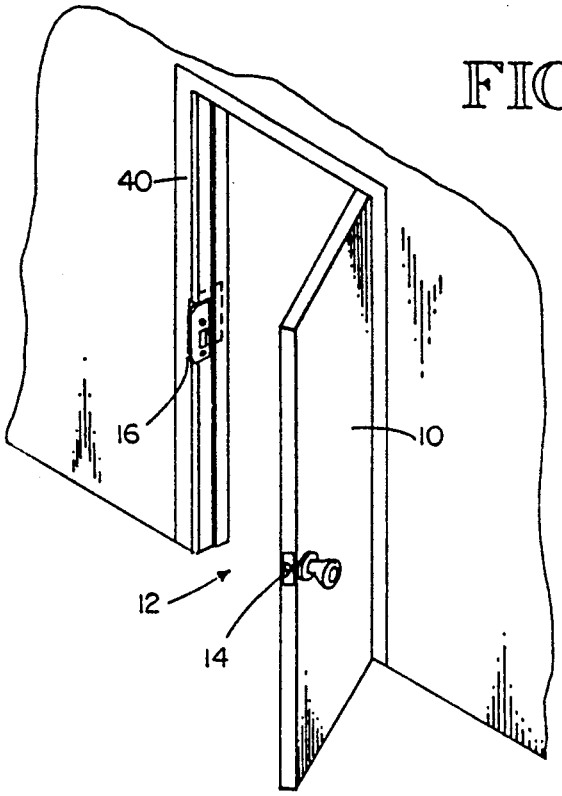
FIG. 1 is a perspective view of a door and door jamb including the apparatus of the present invention.
Figure 3:
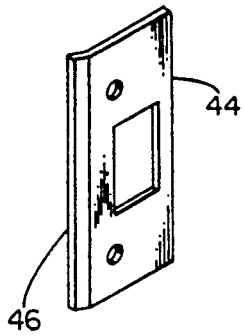
FIG. 3 is an alternative strike plate design which can be used in to present invention.
Figure 2:
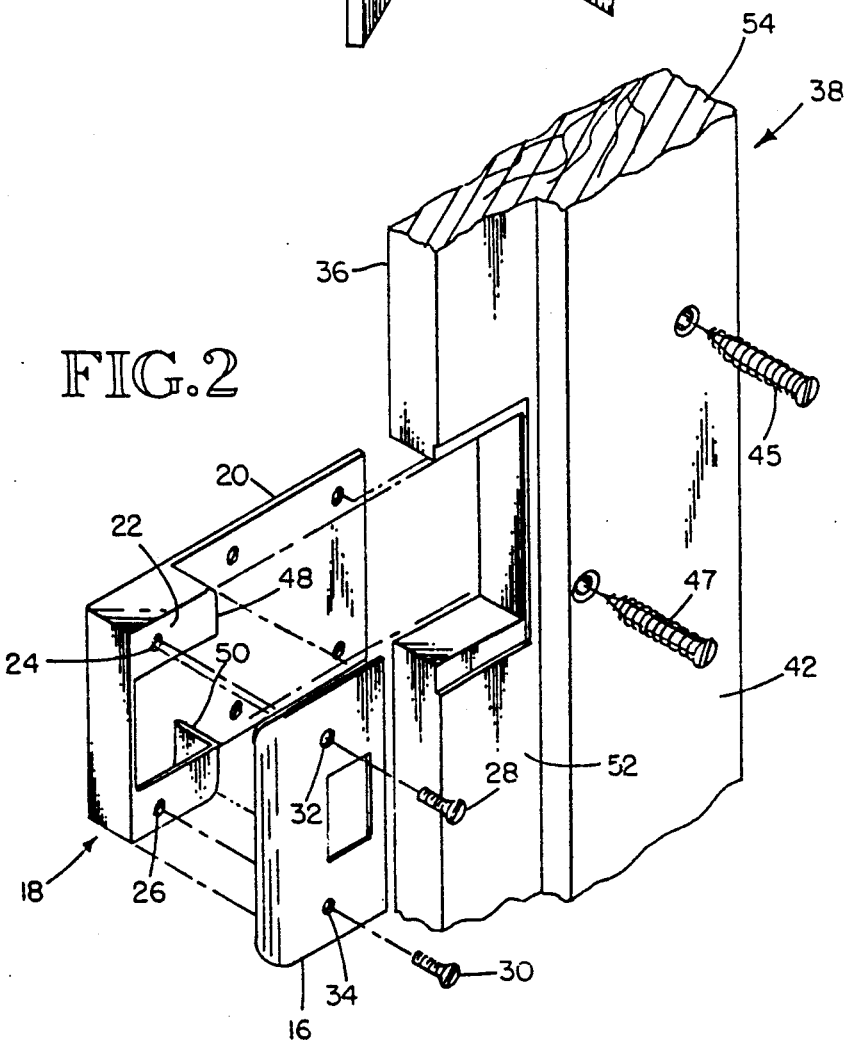
FIG. 2 is a isometric view of the strike plate support and the associated part of the door jamb.
Figure 4A:
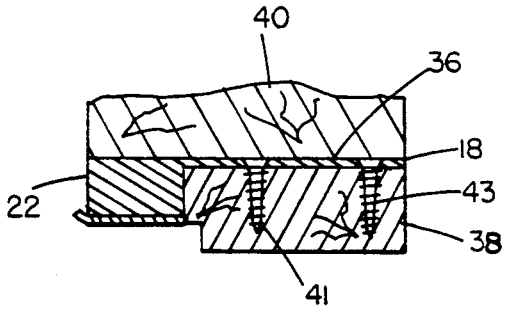
FIG. 4A is a cross sectional view through the framing, door jamb and strike plate support of the present invention showing the strike plate support fastened to the door jamb.
Figure 4B:
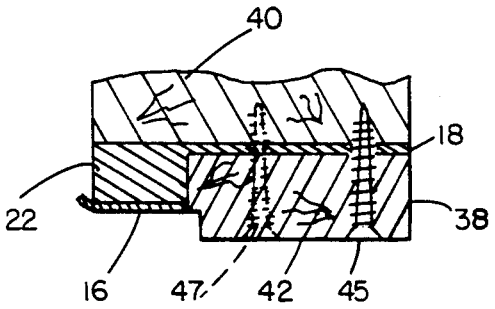
FIG. 4B is a cross sectional view similar to FIG. 4A showing the strike plate support attached to the framing of the door.

Referring to the figures, a door 10 is shown having a conventional locking system generally designated as 12 using a latch bolt 14 which is rigidly extended outwardly from the door 10 when the door 10 is locked. A strike plate 16 is provided which is adapted to receive the latch bolt 14 when the door 10 is closed. When the locking system 12 of door 10 is locked, strike plate 16 receives and holds the latch bolt 14 which rigidly extends from the door. Strike plate 16 is fastened to strike plate support, generally designated as 18. Strike plate support 18 has a spanning portion 20 and a strike box portion 22 having holes 24 and 26. Strike box portion 22 is integral with spanning portion 20 of strike plate support 18. Strike plate 16 is attached to the strike box portion 22 of strike plate support 18 by bolts 28 and 30 used in conjunction with suitable nuts (not shown). The bolts 28 and 30 would be placed through holes 32 and 34 of the strike plate 16, and then through holes 24 and 26 of the strike box portion 22 of strike plate support 18. Nuts would then be attached to the bolts and tightened to effectively fasten strike plate 16 to strike plate support 18. The spanning portion 20 when strike plate 18 is in place will be fastened to the exterior or back side 36 of door jamb 38. The back side 36 of door jamb 38 would be flush to conventional framing designated as 40 such as 2×4's. The spanning portion 20 of support plate 18 can be fastened to door jamb 38 by conventional wood screws 41 and 43 from the back side 36 of door jamb 38, prior to installation. Alternatively, long wood screws 45 and 47 could be used to fasten the spanning portion 20 of support plate 18 from the interior side 42 of the door jamb 38 to door jamb 38 and door frame 40. It should be noted that between strike box portion 22 and spanning portion 20 of strike plate support 18 are side portions 48 and 50 which after strike plate support 18 is cut out and formed can be welded to the strike box portion 22 and spanning portion 20, thereby fortifying the entire strike plate support 18.

In operation, the spanning portion 20 of strike plate support would be fastened to the exterior or back side 36 of door jamb 38. The door jamb 38 would have a rabbeted portion 52 suitably notched to allow the strike box portion 22 of strike plate support 18 when the strike plate 16 is fastened thereto to be flush with the rabbeted portion 52 of the door jamb 38. Door jamb 38 also has a widened portion 54 relative to the rabbeted portion 52 to which the strike plate support 18 is fastened. The latch bolt 14 will be received by the strike plate 16 when the door 10 is closed. When the door is locked, the latch bolt 14 rigidly extends from the door 10 and would be received and held by strike plate 16 and strike box portion 22 which is integral with strike plate support 18 which is fastened to door jamb 38.

As an alternative to latch bolt 14, a conventional, well known dead bolt (not shown) could be used. Dead bolt strike plate 44, therefore, would be used instead of strike plate 16, and the above description would accordingly apply in this case in an obvious manner. Dead bolt strike plate would have preferably a flanged portion 46 that would be bent at an angle between 70° and 90° from the extended plane of the strike plate 44.

The invention may be embodied in other forms without departing from the spirit or essential characteristics thereof. The present embodiments are therefore to be considered in all respects as illustrative and not restrictive, the scope of the invention being indicated by the append claims rather than the foregoing description, and all change which comes within the meaning and range of equivalency of claims are intended to be embraced therein.

What I claim is:

1. In combination a. framing for a door;

b. a door jamb mounted to said framing, said door jamb having an exterior side adjacent said framing and an interior side opposite said exterior side;

c. a door mounted to said door jamb, said door having locking means, said locking means having an extended portion rigidly extending outwardly from said door when said locking means is in a locked position;

d. strike plate support means fastened to said door jamb, said strike plate support means having a strike box integral with said strike plate support means, said strike box adapted to accept said locking means; and e. a strike plate fastened to said strike box, said strike plate adapted to receive the extended portion of locking means when said door is in a closed position and said locking means is in a locked position.

2. The apparatus of claim 1 in which said door jamb has a wide portion, said strike plate support means being fastened to the wide portion of said door jamb.

3. In combination a. framing for a door;

b. a door jamb mounted to said framing, said door jamb having an exterior side adjacent said framing and an interior side opposite said exterior side;

c. a door mounted to said door jamb, said door having locking means, said locking means having an extended portion rigidly extending outwardly from said door when said locking means is in a locked position;

d. strike plate support means having a strike box integral with said strike plate support means, said strike box adapted to receive said locking means, said strike plate support means fastened to said door jamb and said framing by fastening means disposed through the interior side of said door jamb into said strike plate support means and further into said framing;

e. a strike plate fastened to said strike box of said strike plate support means, said strike plate adapted to receive the extended portion of locking means when said door is in a closed position and said locking means is in a locked position.

4. The apparatus of claim 3 in which said door jamb has a wide portion, said strike plate support means being fastened to the wide portion of said door jamb.

* * * * *